US006029676A

United States Patent [19]

Dumler

[11] Patent Number: 6,029,676

[45] Date of Patent: Feb. 29, 2000

[54] COLORING COSMETIC UNIT, IN PARTICULAR MASCARA UNIT

[75] Inventor: Norbert Dumler, Ansbach, Germany

[73] Assignee: Georg Karl geka-brush GmbH, Bechhofen-Waizendorf, Germany

[21] Appl. No.: 09/272,048

[22] Filed: Mar. 19, 1999

[51] Int. Cl.[7] ..... A45D 40/26

[52] U.S. Cl. ..... 132/218; 401/122; 401/129

[58] Field of Search ..... 132/218, 313, 132/317, 320; 401/126, 127, 128, 129, 130, 122; 220/296; 215/330

[56] References Cited

U.S. PATENT DOCUMENTS

| | | | |
|---|---|---|---|
| 3,990,605 | 11/1976 | Hanke et al. | 220/316 |
| 4,090,629 | 5/1978 | Hedgewick | 215/214 |
| 5,141,347 | 8/1992 | Fitjer | 401/126 |
| 5,597,254 | 1/1997 | Vasas | 132/218 |
| 5,810,497 | 9/1998 | Bachmann et al. | 132/313 |

FOREIGN PATENT DOCUMENTS

| | | |
|---|---|---|
| 42 16 525 A1 | 11/1993 | Germany . |
| 44 16 448 A1 | 11/1995 | Germany . |
| 195 08 836 A1 | 9/1996 | Germany . |
| 197 44 181 | 10/1997 | Germany . |
| 198 32 403 | 7/1998 | Germany . |

*Primary Examiner*—Gene Mancene
*Assistant Examiner*—Pedro Philogene
*Attorney, Agent, or Firm*—Browdy and Neimark

[57] ABSTRACT

In a coloring cosmetic unit, in particular a mascara unit, comprising a receptacle for the coloring cosmetic and a screw cap which can be screwed on an external thread of the receptacle neck and on which a handle with an applicator is mounted, it is provided, with a view to improving the properties of handling and use of such a coloring cosmetic unit, in particular to attaining optimal opening and closing properties, produceability by injection or blow molding at a low cost being nevertheless ensured, that the thread on the receptacle neck has a pitch greater than 2 mm, in particular approximately 3 mm.

10 Claims, 2 Drawing Sheets

COLORING COSMETIC UNIT, IN PARTICULAR MASCARA UNIT

BACKGROUND OF THE INVENTION

1. Field of the Invention

The invention relates to a coloring cosmetic unit, in particular a mascara unit, comprising a receptacle for the coloring cosmetic and a screw cap which can be screwed on an external thread of the neck of the receptacle and in which is fixed a handle with an applicator.

2. Background Art

Mascara units of the generic type are known for instance from DE 197 44 181 A1, DE 42 16 525 A1 and DE 198 32 403.

DE 44 16 448 describes a technical solution for positioning the screw cap accurately relative to the neck of the receptacle.

DE 195 08 836 teaches to embody a screw cap such that a sensible and acoustic clicking effect occurs when the cap is screwed down and a stop position is reached.

The coloring cosmetic unit of the type under regard may for instance be a hair dye, nail varnish unit or mascara unit. By way of example, the following substantially deals with a mascara unit.

SUMMARY OF THE INVENTION

It is an object of the invention to improve the properties of handling and use of such a coloring cosmetic unit, in particular to attain optimal opening and closing properties, produceability by injection or blow molding at a low cost being nevertheless ensured.

According to the invention, this object is attained by the thread on the neck of the receptacle having a pitch greater than 2 mm, in particular of about 3 mm, the thread preferably comprising a single convolution.

This design enables the user to open or close the unit by a single turn of the seized screw cap, there being no need of re-screwing, since opening is possible by a half or three-quarter turn. Furthermore, a thread of as coarse a pitch enables the distance between the lower edge of the cap and the shoulder of the receptacle virtually to tend towards zero.

In order for a receptacle with a thread of as coarse a pitch to be manufactured by molding, it is provided that the thread comprises gaps on both sides in the vicinity of the central longitudinal plane of the receptacle, corresponding to the mold parting line. Preferably the thread is put into practice by a single convolution having two gaps opposite to each other by 180°.

In this case it is advantageously provided that turning limit stops—known per se—are disposed in the vicinity of these gaps, which enables these stops to have an optimal configuration while still being easy to manufacture.

Preferably the thread or thread sections, respectively, are in the form of an asymmetric trapezoidal thread, the flank of the thread directed towards the opening of the receptacle being flatter than the opposite flank. This helps obtain high closing pressure.

On the inside of the neck of the receptacle provision can be made for an annular groove for the accommodation of an annular bead formed on the outside of a stripper that can be inserted in the neck of the receptacle.

According to the invention, a coarse coextrusion blown receptacle may be provided, having an internal layer of a mixture of low-density polyethylene (LDPE) and high-density polyethylene (HDPE), a medial layer of ethylene vinyl alcohol EVOH and an external layer of LDPE and HDPE. This selection of material helps obtain optimal barrier properties.

Fundamentally, also PVC (polyvinyl chloride), PET (polyethylene terephthalate), polypropylene, polyamide and polyethylene can be used for the receptacle. The screw cap may consist of polypropylene, POM (polyoximethylene), ABS (acrylonitrile-butadiene-styrene copolymer) or polyethylene. Polypropylene, polyamide, ABS and SAN (styrene acrylonitrile copolymer) may be employed for a slip-on cap for the screw cap.

The wall thickness of the receptacle may range between 0.3 and 5.0 mm. Finally, it can be provided that the inside diameter of the neck of the receptacle tapers conically towards the lower end of the neck, the stripper being inserted into this cone.

In keeping with another preferred embodiment, it is provided that the receptacle consists of glass-clear polyamide. In this case wall thicknesses ranging from 6 to 25 mm can be used, special optical effects being obtained by these wall thicknesses due to the glass-clear material.

Details of the invention will become apparent from the ensuing description of a preferred embodiment of the invention, taken in conjunction with the drawing.

DESCRIPTION OF THE PREFERRED EMBODIMENT

Figure 3:
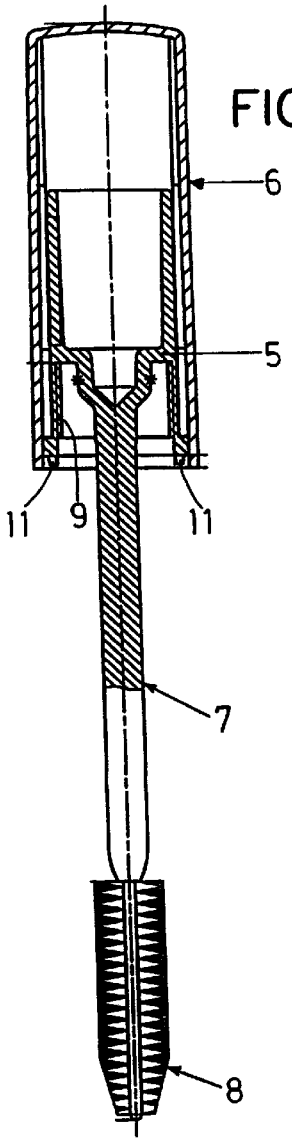
FIG. 3 is a longitudinal section or a lateral view, respectively, of the screw cap, the slip-on cap and the applicator handle inserted in the screw cap and comprising a brush.
Figure 2:
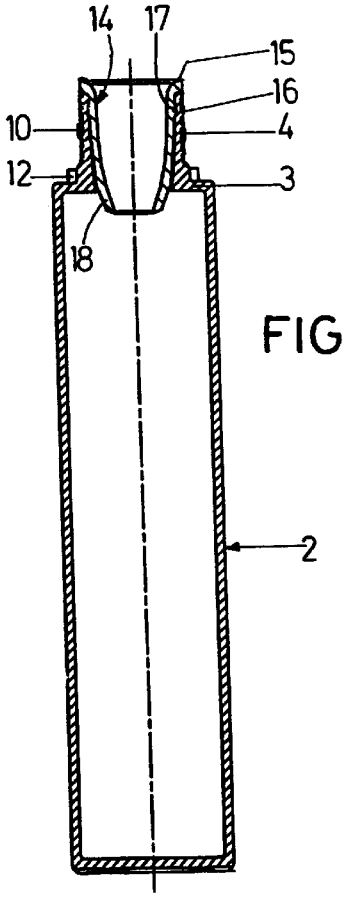
FIG. 2 is a longitudinal section through the receptacle without the screw cap.
Figure 1:
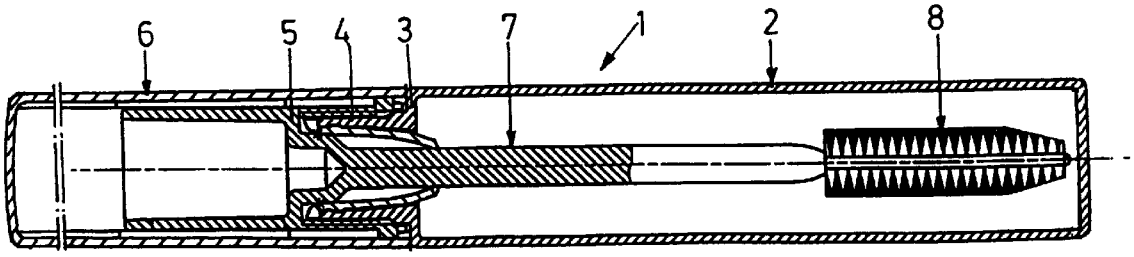
FIG. 1 is a longitudinal section through a coloring cosmetic unit according to the invention in the form of a mascara unit in a closed condition.

A mascara unit 1 illustrated in the drawing comprises a receptacle of plastic material 2, which has a neck 4 set off by an annular shoulder 3 as well as a screw cap 5 and a slip-on cap 6 placed over the screw cap 5.

A handle 7 with an applicator in the form of a brush 8 is molded on the screw cap 5 in a single piece therewith.

The screw cap 5 has an internal thread 9 which cooperates with an external thread 10 on the outside of the neck 4 of the receptacle.

Stops 11 are provided on the underside of the screw cap 5 in a manner known per se, cooperating with stops 12 on the lower end of the neck 4 or on the annular shoulder 3, respectively.

Figure 6:
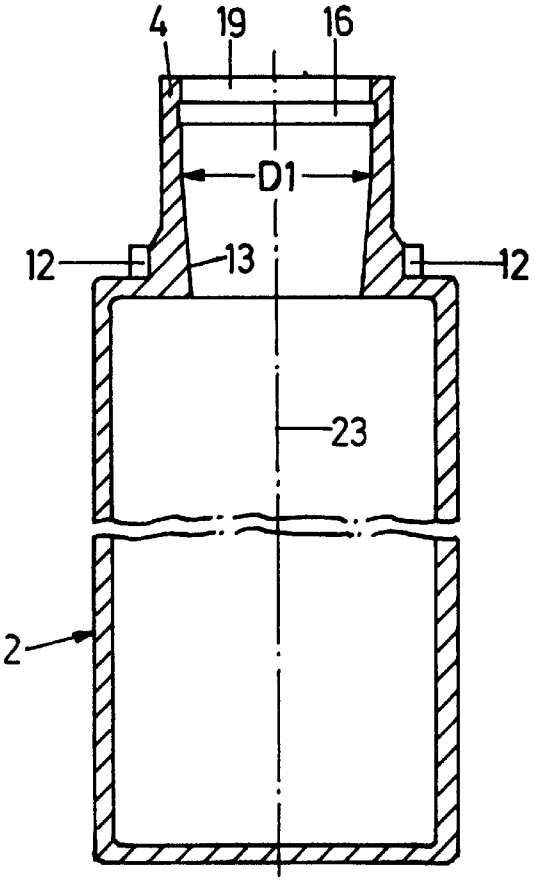
FIG. 6 is a cut through the receptacle, the portion of the neck of the receptacle being enlarged as compared to the illustration in FIG. 2.

As seen in particular in FIG. 6, the inside diameter D1 of the neck 4 tapers towards the interior of the receptacle 2, forming a cone 13 into which a stripper 14 of rubber-elastic material is inserted, having positive fit. By its upper edge 15, the stripper 14 enclasps the upper edge of the neck 4, working in the way of a sealing ring in this area. Provided on the inside of the neck of the receptacle is an annular groove 16 with which engages a corresponding annular bead 17 on the outside of the stripper 14 for tight axial fit to be achieved. Stripper fingers 18 of the stripper 14 extend from the annular shoulder 3 in the direction towards the interior of the receptacle 2.

Figure 5:
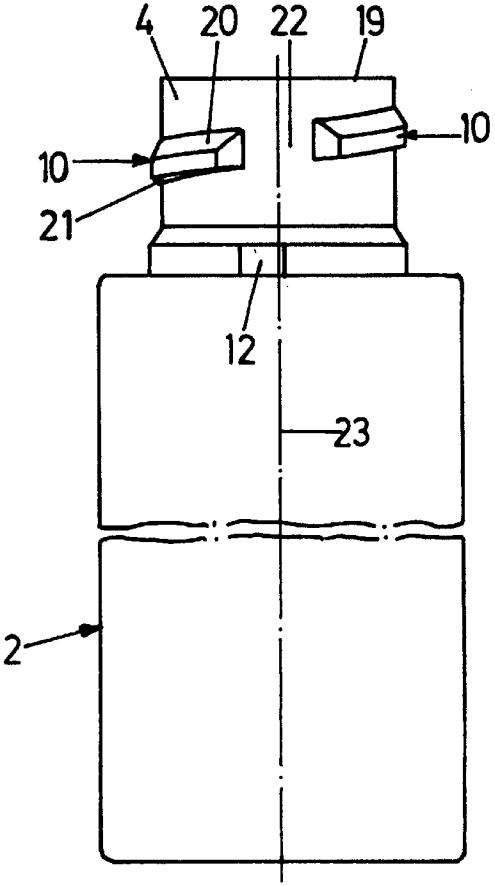
FIG. 5 is a lateral view rotated by 90° as compared to FIG. 4.
Figure 4:
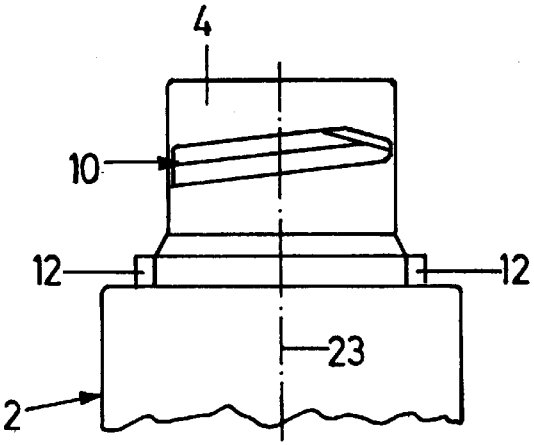
FIG. 4 is a lateral view of the portion of the neck of the receptacle.

The design of the external thread 10 on the neck 4 will become apparent in particular from FIGS. 4 and 5. The thread 10 comprises a convolution in the form of an asymmetric trapezoidal thread with a flank 20 sloping more flatly towards the opening 19 on the neck 4 than a steeper opposite flank 21.

The convolution of the thread 10 has two gaps 22 opposite to each other, one of which is seen in FIG. 5. The gaps extend on both sides of the central longitudinal plane 23 corresponding to the mold parting line. As seen in FIG. 5, the mentioned stops 12 are located below the gaps 22 and are laterally displaced relative to the central longitudinal plane 23 in the vicinity of these gaps.

What is claimed is:

1. A coloring cosmetic unit, in particular a mascara unit (1), comprising:

a receptacle (2) for the coloring cosmetic having a receptacle neck (4) with an external thread thereon;

a screw cap (5) which can be screwed on said external thread (10) having a handle (7) with an applicator (8) mounted thereon;

the external thread (10) on the receptacle neck (4) having a pitch between 2 mm and 3 mm and being formed with a single thread convolution;

stops (12) being provided on the receptacle neck (4) spaced apart from said single thread convolution;

wherein the single thread convolution is interrupted by gaps (22) on both sides in a vicinity of a central longitudinal plane (23) of the receptacle corresponding to a mold parting line through the receptacle.

2. A coloring cosmetic unit according to claim 1, wherein the thread (10) which is formed by a single convolution has two gaps opposite to each other by 180°.

3. A coloring cosmetic unit according to claim 1, wherein turning limit stops (11) on the screw cap (5) are disposed in the vicinity of the gaps (22) to engage the stops on the receptacle neck (4).

4. A coloring cosmetic unit according to claim 1, wherein the thread (10) is an asymmetric trapezoidal thread.

5. A coloring cosmetic unit according to claim 1, wherein an annular groove (16) is provided on an inside of the receptacle neck (4) to accommodate an annular bead (17) formed on an outside of a stripper (14) which can be inserted in the receptacle neck (4).

6. A coloring cosmetic unit according to claim 1, wherein the receptacle (2) is a coextrusion blown receptacle, having an internal layer of a mixture of LDPE and HDPE, a medial layer of EVOH and an external layer of a mixture of LDPE and HDPE.

7. A coloring cosmetic unit according to claim 1, wherein the receptacle consists of PET.

8. A coloring cosmetic unit according to claim 1, wherein a wall thickness ranges between 0.3 and 5 mm.

9. A coloring cosmetic according to claim 1, wherein a receptacle wall consists of a glass-clear material and has a wall thickness of 6 to 25 mm.

10. A coloring cosmetic unit according to claim 1 wherein the receptacle consists of glass-clear polymide.

* * * * *